United States Patent [19]

Borst

[11] Patent Number: 5,012,927

[45] Date of Patent: May 7, 1991

[54] RECLOSABLE THERMOFORMED BLISTER CARD DISPLAY PACKAGE

[75] Inventor: Rodney D. Borst, Oregon, Wis.

[73] Assignee: Placon Corporation, Madison, Wis.

[21] Appl. No.: 521,223

[22] Filed: May 9, 1990

Related U.S. Application Data

[63] Continuation-in-part of Ser. No. 406,137, Sep. 11, 1989, Pat. No. 4,930,627.

[51] Int. Cl.[5] ..... B65D 73/00

[52] U.S. Cl. ..... 206/470; 206/45.23; 206/45.34

[58] Field of Search ..... 206/44 R, 45.23, 45.24, 206/45.34, 461, 467, 469, 470, 601, 806, 807

[56] References Cited

U.S. PATENT DOCUMENTS

| | | |
|---|---|---|
| 3,034,819 | 3/1960 | Tupper . |
| 3,111,220 | 11/1963 | Bostrom . |
| 3,394,801 | 7/1968 | Hanson . |
| 3,437,199 | 4/1969 | Jacobson . |
| 3,448,853 | 6/1969 | Repko . |
| 3,463,309 | 8/1969 | Szostek . |
| 3,581,884 | 6/1971 | Caldwell . |
| 3,581,885 | 6/1971 | Wald . |
| 3,746,155 | 7/1973 | Seeley . |
| 3,783,996 | 1/1974 | Gerare et al. . |
| 3,967,730 | 7/1976 | Driscoll et al. . |
| 4,005,776 | 2/1977 | Seeley . |
| 4,106,621 | 8/1978 | Sorenson . |
| 4,146,128 | 3/1979 | Hogg et al. . |
| 4,155,454 | 5/1979 | Ryden . |
| 4,200,193 | 4/1980 | Boyle . |
| 4,236,637 | 12/1980 | Castner, Sr. et al. . |
| 4,300,682 | 11/1981 | Kuchenbecker . |
| 4,308,986 | 1/1982 | Parrilli . |
| 4,319,684 | 3/1982 | Backman et al. . |
| 4,360,106 | 11/1982 | Irvine et al. . |
| 4,378,068 | 3/1983 | Bell . |
| 4,415,084 | 11/1983 | Hauser et al. . |
| 4,496,052 | 1/1985 | Nertman . |
| 4,569,442 | 2/1986 | Bushey . |
| 4,687,129 | 8/1987 | Cugley . |
| 4,724,964 | 2/1988 | Hernandez . |
| 4,739,883 | 4/1988 | Mohs et al. . |
| 4,784,268 | 11/1988 | Perchak . |

FOREIGN PATENT DOCUMENTS

| | | |
|---|---|---|
| 2124931 | 11/1972 | Fed. Rep. of Germany . |
| 1081502 | 8/1967 | United Kingdom . |

OTHER PUBLICATIONS

Placon drawings of cube box shaker 2/12/86.
Placon drawings of shaker 12/18/86.

*Primary Examiner*—Jimmy G. Foster
*Attorney, Agent, or Firm*—Lathrop & Clark

[57] ABSTRACT

A reclosable display package of thin flexible thermoformed material with a bubble body for mounting on a backing card is disclosed. The bubble body has top, left, right, and bottom flanges, and faces defining a bubble which encloses an article compartment. An egress opening is formed in one face or in portions of several faces of the body. The reclosable display package includes a cover independent of the body and connected to a flange of the body by an integral hinge. The cover is pivotable about the integral hinge to fully close the egress opening in the body of the package.

6 Claims, 7 Drawing Sheets

RECLOSABLE THERMOFORMED BLISTER CARD DISPLAY PACKAGE

BACKGROUND OF THE INVENTION

This application is a continuation-in-part of the application Ser. No. 07/406,137 filed Sept. 11, 1989 which issued as U.S. Pat. No. 4,930,627 on June 5, 1990.

FIELD OF THE INVENTION

This invention pertains generally to the field of packaging and containers, and particularly to reclosable display packages with blisters thermoformed from thin flexible plastic material and affixed to card stock bases.

DESCRIPTION OF THE PRIOR ART

The standard blister package consists of a clear plastic thermoformed bubble or "blister" attached to a backing card by means of an integral flange on four sides. This type of package gives a consumer a clear view of the contents of the package, is economical to produce, and is easy to load, close and ship. Blister packages are particularly well-adapted for containing a number of small articles in one package. However, the prior art blister packages, because they require that the plastic blister be sealed by means of adhesive or heat sealing on all peripheral flanges, tend to be destroyed on the first opening. Where the articles in such packages will not be entirely consumed at the first use it is usually necessary and desirable for the consumer to transfer the articles to a second container if the original container is destroyed or seriously damaged when it is opened.

Prior art blister packages that are reclosable usually require the consumer to cut, tear or deform the package in some way to access the contents. For consumer uses especially, it is desirable that the package not only be openable and reclosable, but that it be openable and reclosable without substantial damage or disfigurement to the package. A package which will be on display in a consumer's home should be attractive, clearly labeled, and provide ready identification of its contents. The prior art is replete with examples of reclosable blister packages but these generally require that the consumer cut or fold the package after purchase in some way. Packages that force the consumer to use separate implements and manually shape the reclosable package are inconvenient and, because they rely on an untrained consumer for final forming, are less consistent and reliable in their reclosable features. Furthermore, prior art packages that are easy to open often achieve this characteristic at the cost of protection to the contents of the package. It is imperative that packages for consumer products, especially those products for human consumption or bodily care, be secure against tampering prior to opening, or that the package give clear evidence of any tampering that may have taken place.

What is needed is a blister card package made from one thermoformed plastic blister that can be easily opened and reclosed without damage to the package, which can be affixed to the backing card in a tamper-resistant fashion, and which can be secured to the backing card while fully loaded.

SUMMARY OF THE INVENTION

A reclosable display package according to the present invention has a backing card and a thermoformed thermoplastic blister with top, left, right, and bottom peripheral flanges which are sealed to the backing card.

The blister has a front face which is spaced from the backing card by top, left, right, and side faces which adjoin the top, left, right, and bottom flanges respectively. The side faces, the front face and the card define an article compartment. An egress opening is formed in the article compartment by portions of the side face. The egress opening may be formed by portions of the side, front and bottom faces. A cover is independent of the body and connected to a flange of the body by an integral hinge. The cover is pivotable about the integral hinge between a first position in which the cover overlies a portion of the body and fully closes the egress opening in the side face and a second position in which the egress opening is fully revealed for unimpeded access thereto. A means is formed in the body front face and the cover for releasably fastening the cover to the front face in the cover first position.

It is an object of the present invention to provide a blister package with a card stock base and a reclosable cover sealed on all four sides.

It is a further object of the present invention to provide a reclosable blister package with a depending integral hinge adapted to preventing tampering with the contents of the package.

It is further an object of the present invention to provide a blister package with an egress opening that may be covered or exposed by a rotatable cover.

It is also a further object of the present invention to provide a reclosable blister package which may be displayed in a stand-up or a hanging position.

It is a still further object of the present invention to provide a reclosable blister package that may be stood upright by the consumer after the package has been opened to provide convenient access to the package contents.

These objects, and others will become apparent from the following detailed description taken in conjunction with the accompanying drawings showing a preferred embodiment of the invention for exemplification.

DESCRIPTION OF THE PREFERRED EMBODIMENT

Figure 1:
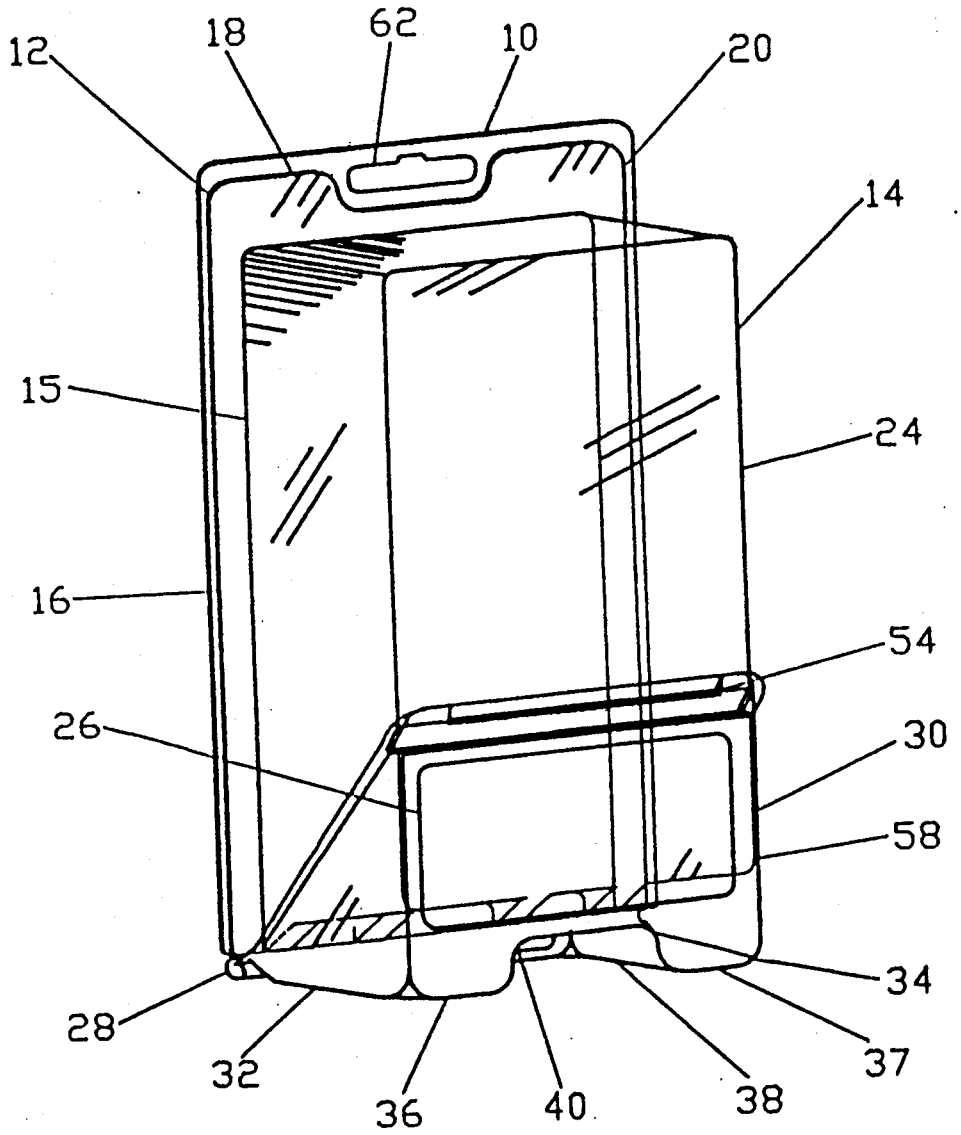
FIG. 1 is a perspective view of a blister card package of this invention, showing the package in the closed position.
Figure 2:
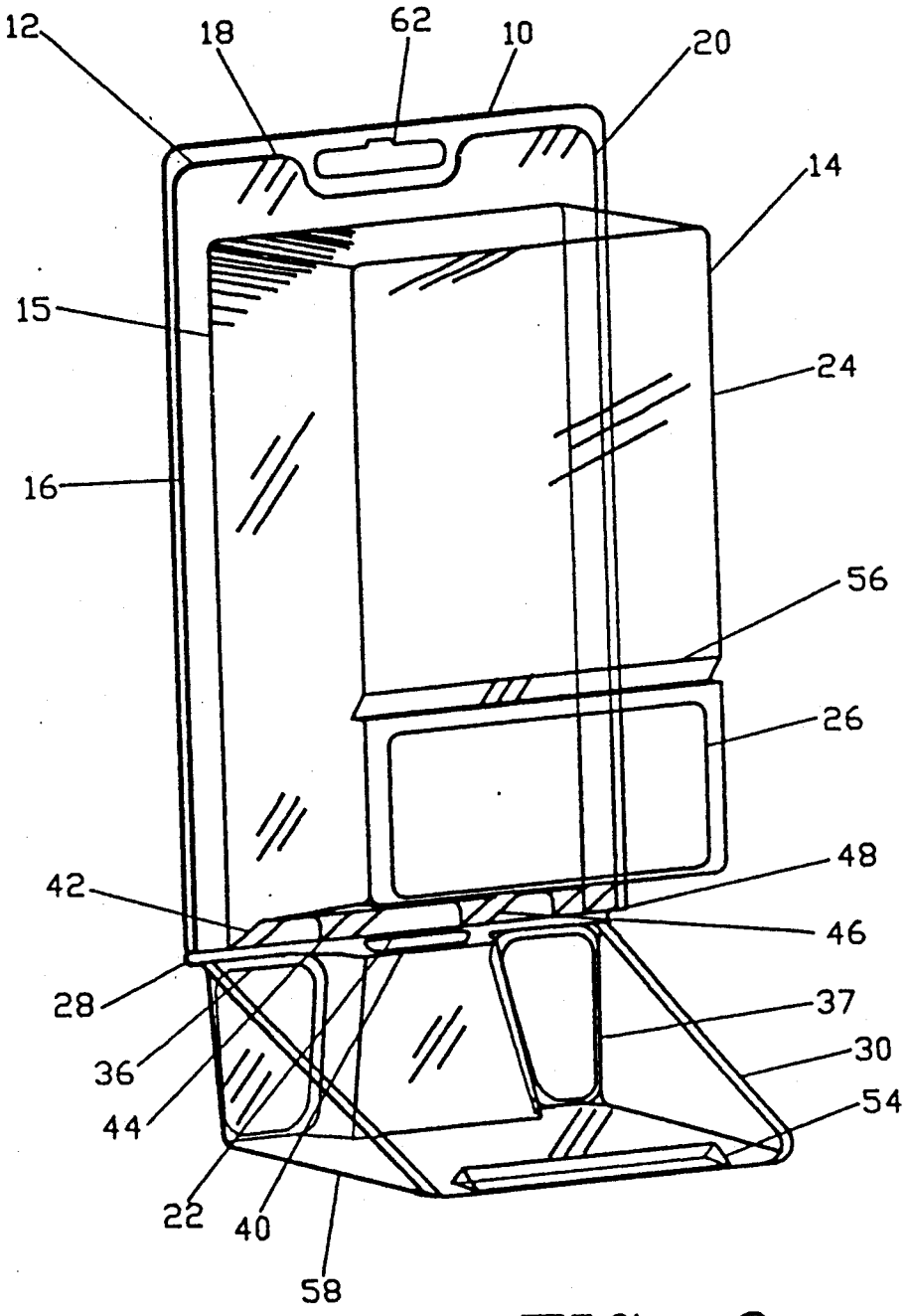
FIG. 2 is a perspective view of the package of FIG. 1, showing the package in the opened position.

Referring more particularly to FIGS. 1–8 wherein like numerals refer to similar parts, the package includes the usual backing card 10 to which is bonded the thermoformed blister 12. The blister includes a bubble body 14 having an article compartment 15, a left flange 16, a top flange 18, a right flange 20, and a bottom flange 22. The body also has a front face 24, and an egress opening 26. Depending from the bottom flange 22 and rotating about an integral hinge 28 is a rotatable cover 30. The cover preferably has two feet 32, 34 for the purpose of enabling the package to stand up straight. In FIGS. 1 and 2 can be seen the planar base portions 36, 37 of the feet. The planar base portions of the feet are in substantially the same plane as the integral hinge 28 when the cover 30 is closed as in FIGS. 1 and 3. The two feet are positioned on either side of and define an accessway 38 which provides access for a sealant tool to a sealant tool opening 40. By means of this accessway 38 the sealant tool can extend through the sealant tool opening 40 to affix the bottom flange 22 to the backing card 10 when the cover 30 is in a closed position. This feature enables the blister 12, with the cover 30 closed, to be loaded with articles prior to sealing the blister 12 to a backing card 10.

Figure 3:
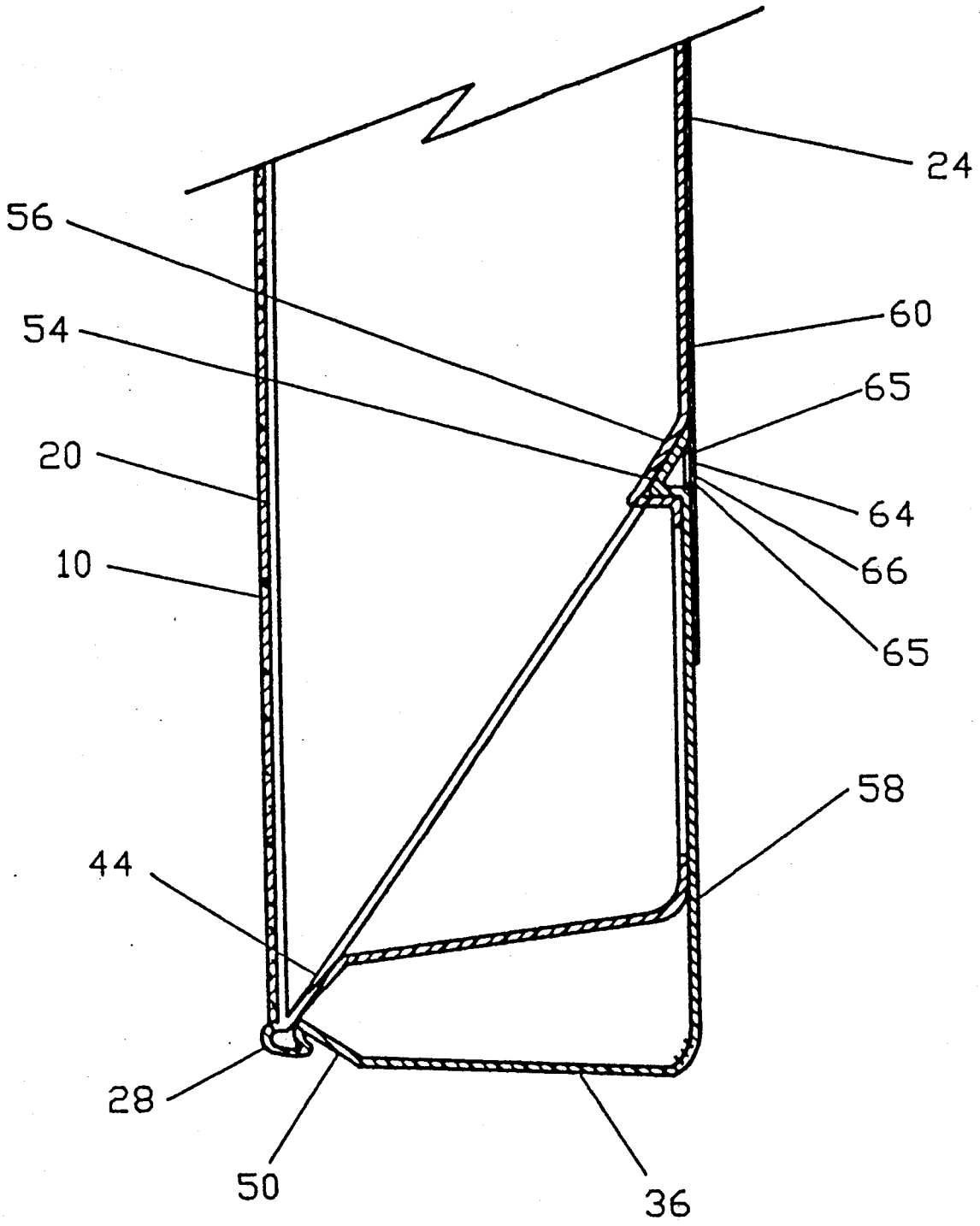
FIG. 3 is an enlarged fragmentary sectional view of the package of FIG. 1 showing the package in a closed position with a tamper-resistant label applied to the front face.

In FIG. 2 can be seen four angled gussets 42, 44, 46, 48 projecting upwardly from the bottom flange 22. These preferred gussets serve to stiffen the body bubble around the egress opening 26 and the bottom flange 22. The gussets also stiffen the bottom flange 22 and assist in retaining the bottom flange against the backing card 10 during and after sealing so as to insure a close and temper-resistant seal along the bottom of the article compartment 15. They also serve to maintain the definition of the integral hinge 28. On the opposite side of the integral hinge from the gussets, and also serving to provide definition to the integral hinge, are the angled set backs 50, 52 of the feet 32, 34 adjacent to the planar portions 36, 37. As shown in FIG. 3, these angled set backs also allow the planar portions of the feet 36, 37 to lie in substantially the same plane as the integral hinge 28 when the package is in an upright, standing position, thereby making it possible for the package to stand vertically. The location and structure of the angled set backs 50, 52 adjacent to the integral hinge 28 particularly serve to stiffen the blister around the integral hinge and prevent excessive distortion of the integral hinge, enabling it to stiffly resist attempts at tampering with the bottom flange 22.

The integral hinge 28 depends from the bottom flange 22 and has a roughly C-shaped cross section providing that when the cover 30 is closed over the egress opening 26 and the bottom flange 22 is affixed to the backing card 10 the length of the integral hinge 28 will extend backwards slightly beyond the plane of the backing card 10. As shown in FIG. 3, the integral hinge 28 thus blocks access to the interior of the body bubble between unsealed portions of the bottom flange 22 and backing card 10, giving added protection against tampering with or contamination of the package contents.

The cover 30 may be repeatedly rotated about the integral hinge 28 to cover or reveal the egress opening 26. The cover is held in the closed position by means of a projecting wedge 54 extending from the cover and a wedge-shaped depression 56 located in the front face 24 above the egress opening 26. The wedge-shaped depression 56 is suited to hold and retain the projecting wedge 54 in snap-fit relation.

To fill the package with articles the cover 30 is first closed over the egress opening 26. As seen in FIG. 3 the front face 58 of the cover and the front face 24 of the bubble body are then in substantially the same plane and adapted to receive a continuous adhesive-backed label 60 either before or after the package is filled. This label serves to seal the package. With the cover in the closed position, the package is filled with articles, the backing card 10 is placed along the thermoformed blister, and the left flange 16, top flange 18, and right flange 20 are affixed to the backing card by heat sealing. The bottom flange 22 is reached by a sealant tool through the sealant tool opening 40 in the cover 30 and also affixed to the backing card 10.

The retailer may now display the package either in a hanging fashion by inserting a hook through the display slot 62, or on a shelf in an upright standing position by standing the package on the base composed of the feet 32, 34 and the integral hinge 28. The normally smooth, uninterrupted face of the adhesive label of a displayed package will then readily indicate any tampering with or pilferage of the contents of the package. This resistance to clandestine tampering makes the package particularly suited for health care or cosmetic articles, such as cotton swabs.

The adhesive label 60 for the package may contain an integral tear tab 64 with perforated lines 65 separating the tab from the portions of the label affixed to the front face 24 of the body 14 and the front face 58 of the cover 30. This tear tab 64 overlies the joint formed by the projecting wedge 54 and the wedge-shaped depression 56, and is not affixed to the blister at all due to its backing by a paper backing 66 which also serves to stiffen the tear tab. When the consumer wishes to open the package he simply grasps the extending portion of the tear tab 64 and pulls it across the face of the blister 12, separating the tab 64 from the two remaining portions of the adhesive label 60 along the perforated lines 65. Once the tear tab 64 has been removed the cover 30 may be freely disengaged and rotated.

Alternatively, an adhesive label without a tear tab may be employed. To open the package, the consumer can slit the adhesive label 60 with a sharp object such as a knife, nail file, or fingernail along the joint formed by the projecting wedge 54 and the wedge-shaped depression 56 which acts as a template for breaking any adhesive label applied over the joint. Or, if desired, the label can be perforated along an intended cutline to facilitate use of fingernails to open.

Figure 4:
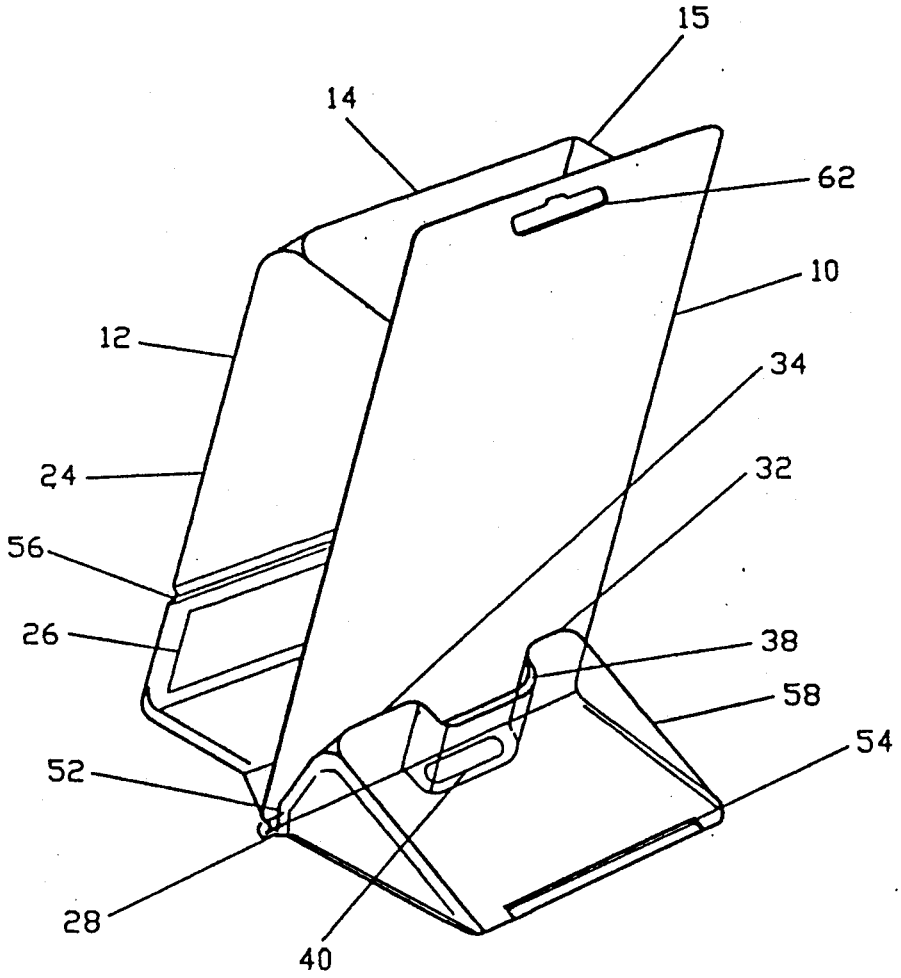
FIG. 4 is a rear perspective view of the package of FIG. 1 shown in an opened, upright, inclined position.
Figure 5:
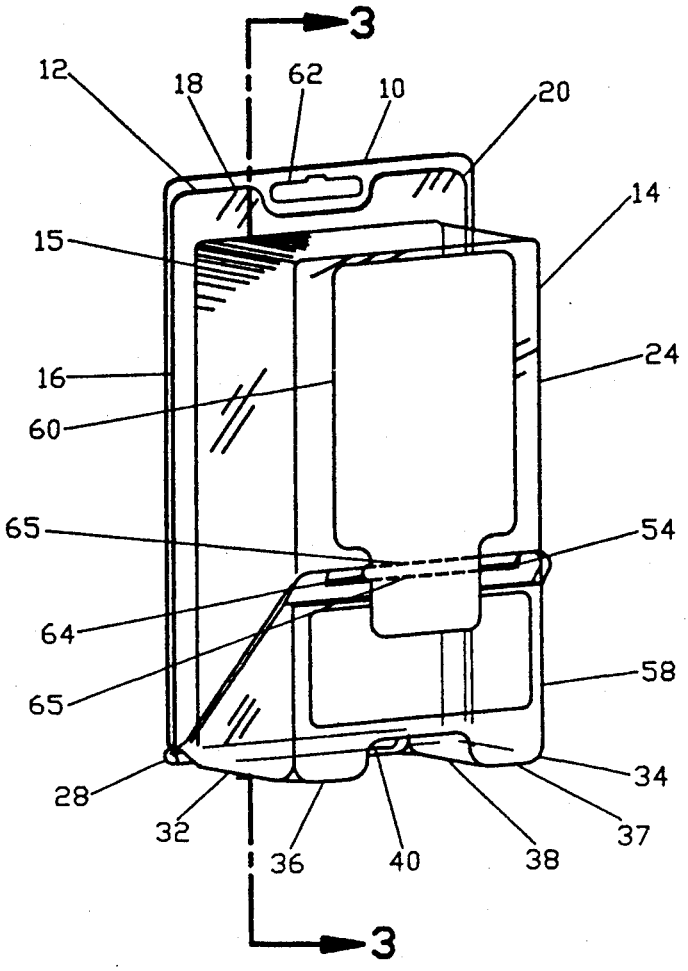
FIG. 5 is a perspective view of the blister card package of FIG. 1 with a tamper-resistant label.

When the consumer folds down the cover 30 there is ready access to the articles contained within the package through the egress opening 26. If the consumer desires, he may fold the cover backwards around the integral hinge 28 until the planar portions of the feet 36, 37 meet the back of the backing card 10. The cover then serves to support the opened package in a backwardly inclined upright position as shown in FIG. 4 for ready inspection of and access to the package contents by consumers.

Figure 6:
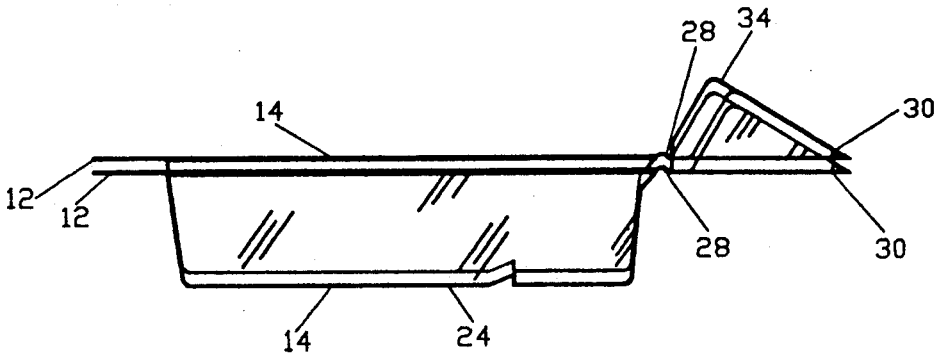
FIG. 6 is a side view of two of the blisters of the invention showing how the blisters may be compactly nested and stacked.

Prior to affixing the backing cards, the thermoformed blisters 12 may be stacked in nested relation as shown in FIG. 6 to provide for compact shipping and storage.

Figure 7:
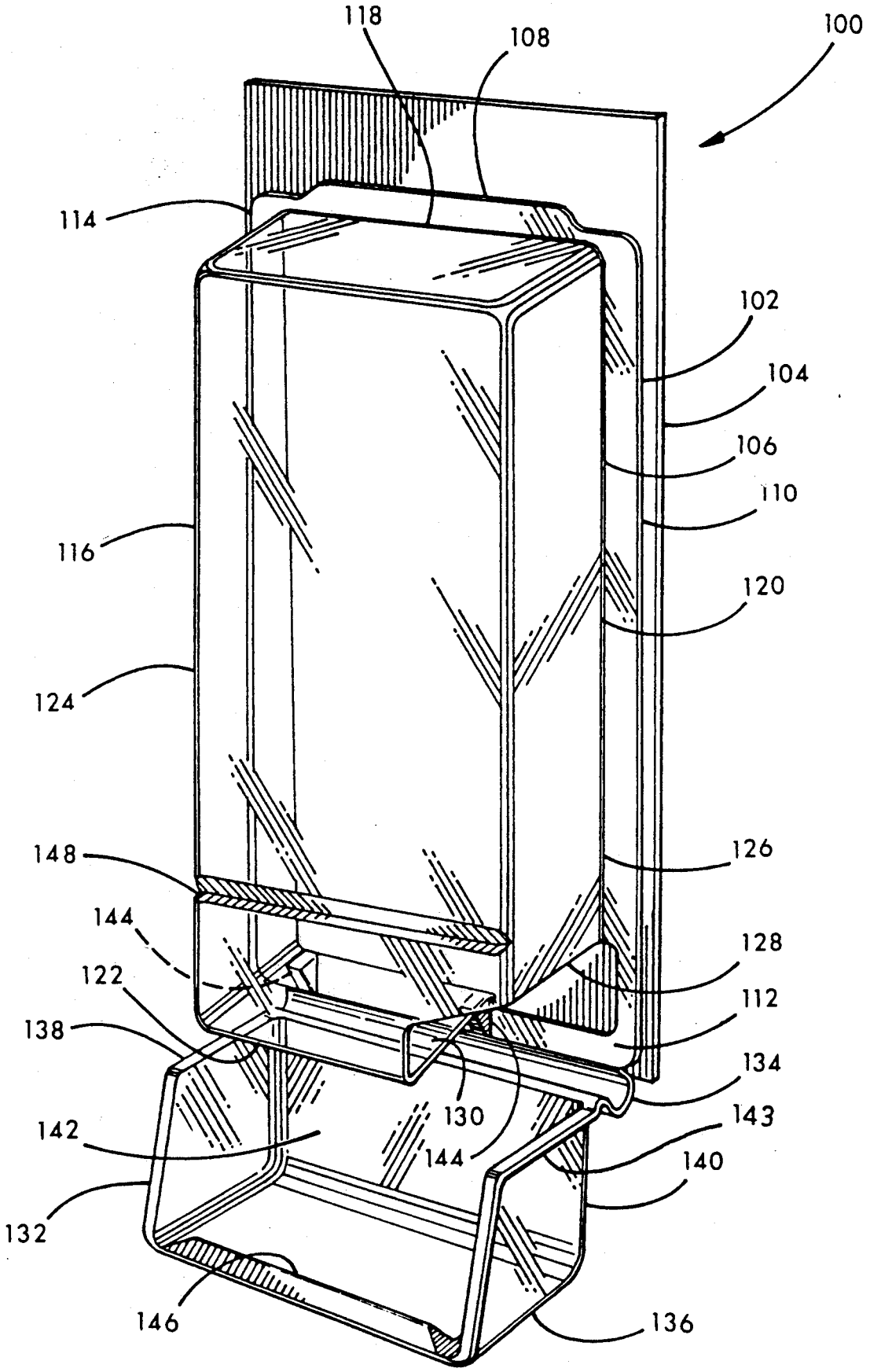
FIG. 7 is a perspective view of an alternative embodiment of a package of this invention having an egress opening formed by portions of the front, side, and bottom faces of the bubble body and shown in an open position.
Figure 8:
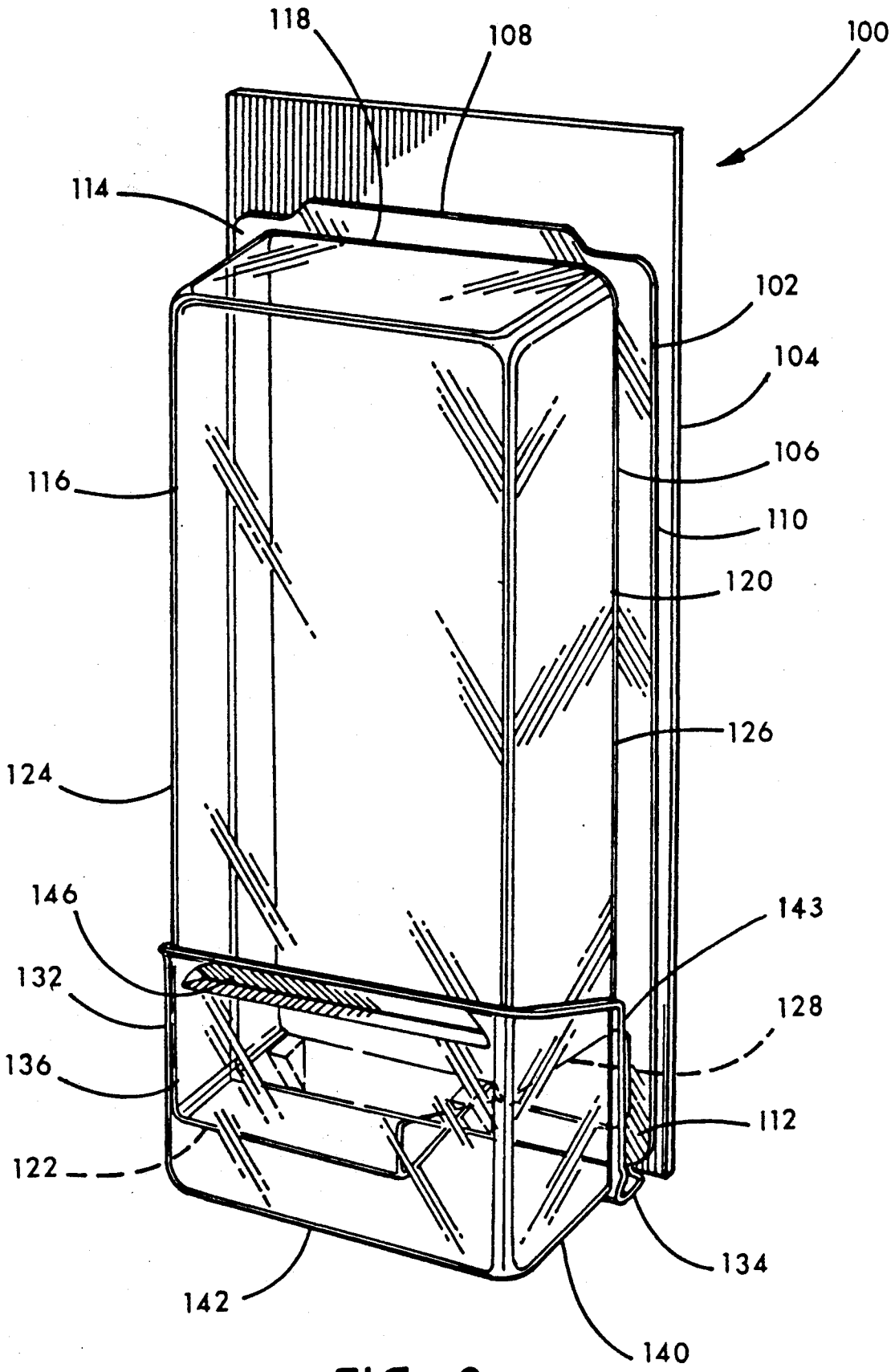
FIG. 8 is a perspective view of the package of FIG. 7 in a closed position.

An alternative embodiment of the package of this invention is shown in FIGS. 7 and 8. The package 100 has a thermoformed blister 102 which is attached to a backing card 104 by a top flange 108, a right flange 110, a bottom flange 112, and a left flange 114 formed on the bubble body 106. The bubble body 106 also has a front face 116 which is substantially parallel to the flanges 108, 110, 112, 114; a top face 118 connecting the top flange 108 to the front face 116; a right side face 120 connecting the right flange 110 to the front face 116 and adjoining the top face 118; a bottom face 122 connecting the bottom flange 112 to the front face 116 and adjoining the right side face 120; and a left side face 124 connecting the left flange 114 to the front face 116 and adjoining the top face 118 and the bottom face 122. The front, top, right side, bottom and left side faces 116, 118, 120, 122, 124 together with the backing card 104 define an article compartment 126 for containing the contents of the package 100.

An egress opening 128 is formed in the bubble body 106. The opening 128 may be formed by die-cutting away a portion of the plastic blister 102. The egress opening is located towards the bottom of the upright package 100 and is defined by portions of the right side face 120, the front face 116, and the bottom face 122. Typically, in cutting the blister 102 to form the egress opening 128, a Portion of the right flange 110 will also be removed. Preferably the cut-out portion of the right flange 110 will extend only part way across the flange, although the entire width of the flange may be removed if desired. The egress opening 128 will permit the individual extraction of articles from within the article compartment 126. The package 100 is particularly adapted to dispensing thin strip-like articles such as individually wrapped adhesive bandages which may be stacked within the article compartment 126 with the stack resting on the interior surface 130 of the bottom face 122.

The egress opening 128 may be covered by the cover 132 which is independent of the body 106 and connected to the bottom flange 112 by an integral hinge 134. The integral hinge is of a closed C-type structure and extends partially beyond the plane of the bottom flange 112 to block access to the article compartment 126 beneath the bottom flange 112. The cover has a cover front face 136, a left side face 138 and a right side face 140. A base face 142 extends between the left side face 138 and the right side face 140 of the cover 132 and adjoins the front face 136 of the cover 132. The cover 132 is pivotable about the integral hinge 134 between a first position in which the cover overlies a portion of the body so that the egress opening 128 is fully closed. In the closed position the front, right side, and base faces 136, 140, 142 will cover and block access to the egress opening 128. The cover has a continuous peripheral flange 143 wich extends from the integral hinge 134 on the left side of the cover along the left side face 138, the front face 136, and the right side face 140 of the cover 132 to adjoin the integral hinge 134 on the right side of the cover. In a closed position the flange on the right side face 140 will along a portion of that face be parallel to the front face 136 of the cover as well as the front face 116 of the bubble body 106. The cover flange will thus adjacently overlie the right flange 110 of the body 106 preventing access to the egress opening 128.

When in the closed position as shown in FIG. 8 the package 100 may be stood upright by resting the package on portions of the base face 142 of the cover 132 which are in the same plane as the most extended portion of the integral hinge 134.

The bubble body 106 has two strengthening gussets 144 which extend between the bottom flange 112 and the bottom face 122 and strengthen and reinforce the bubble body 106. The gussets also partially define the integral hinge 134.

As on the blister 12, the blister 102 of the package 100 has means for releasably fastening the cover 132 to the front face 116 of the bubble body 106. In the package 100 that means comprises a projecting wedge 146 formed on the cover front face 136 and a wedge shaped depression 148 formed on the cover front face 116. Alternatively, any conventional latching mechanism may be formed in the cover and body of the blister.

The package 100 does not have a sealant-tool opening. In this embodiment the package, adapted to receiving strip-like articles, may be filled and sealed to the backing card 104 with the cover in an open position. When the cover is open the sealant tool has direct access to the body flange 112, thus no sealant-tool opening is required. A sealant-tool opening may be provided in the package 100 if it is desired to fill the package with articles which might not be fully retained while loading the package with the cover open.

Packages embodying this invention need not contain all the features of the preferred embodiment. Packages of this invention may be formed with more than two feet on the cover, or with no feet at all. The sealant tool opening may be larger or smaller than illustrated or may be absent altogether if the blister is to be sealed to the card with the cover open. There may be two or more sealant tool openings. The cover may be attached at the top or the sides of the package. There may be more than one cover on a package, with a proportionate increase in number of integral hinges and sealant tool openings. The blister bubble may be of a non-rectangular plan, or may be particularly shaped to suit any contents. There may be more than one blister on a card. The card itself may be formed of plastic. Instead of affixing a paper label to the blister face, the plastic of the blister may be imprinted.

The egress opening may be in the top, bottom or side faces of the body bubble, or in a combination of faces. The cover may be of any appropriate dimensions to effectively cover the egress opening. The face or faces in which the egress opening is formed may be formed as a planar, a multi-planar, or a curved surface.

It should be understood that this invention is not limited to the particular construction and arrangement of parts herein illustrated and described, but embodies all such modified forms as come within the scope of the following claims.

I claim:

1. A display package comprising:

a) a backing card;

b) a thermoformed thermoplastic blister having top, left, right and bottom peripheral flanges sealed to the backing card, a front face spaced from the backing card by top and bottom faces and a left side face and a right side face, which faces adjoin the top, bottom, left and right flanges respectively, wherein the adjoining faces, the front face, and the card define an article compartment;

c) an egress opening in the article compartment defined by portions of a side face located near the bottom face;

(d) a cover independent of the body and connected to the bottom flange of the body by an integral hinge, the cover being pivotable about the integral hinge between a first position in which the cover overlies a portion of the body and fully closes the egress opening and a second position in which the egress opening is fully revealed for unimpeded access thereto; and e) means formed in the front face of the blister and the cover for releasably fastening the cover to the front face in the cover first position.

2. The package of claim 1 wherein the cover has a front face with an adjoining side face substantially perpendicular to the front face and a peripheral flange on the side face which is parallel to the cover front face and spaced from the cover front face such that when the cover is closed on the body the cover peripheral flange overlies and is adjacent to the flange of the body adjacent the egress opening.

3. A display package comprising:

a) a backing card;

b) a thermoformed thermoplastic blister having top, left, right and bottom peripheral flanges sealed to the backing card, a front face spaced from the backing card by top, left, right, and bottom side faces which adjoin the top, left, right, and bottom flanges respectively, wherein the side faces, the front face, and the card define an article compartment;

c) an egress opening in the article compartment wherein the egress opening is formed by portions of the front face, the bottom face, and a side face adjoining the bottom face;

d) a cover independent of the body and connected to a flange of the body by an integral hinge, the cover being pivotable about the integral hinge between a first position in which the cover overlies a portion of the body and fully closes the egress opening and a second position in which the egress opening is fully revealed for unimpeded access thereto; and e) means formed in the front face of the blister and the cover for releasably fastening the cover to the front face in the cover first position.

4. A thermoformed blister of flexible plastic material for a reclosable blister card display package comprising:

a) a bubble body, the body having an article compartment, and top, left, right and bottom peripheral flanges for sealing to a backing card to close the article compartment, a body front face spaced from the flanges, a body left side face and a body right side face adjoining the front face and a flange, and a body bottom face connecting the front face to the bottom flange and adjoining the left and right side faces, wherein a side face has portions located near the bottom face defining an egress opening;

b) a cover independent of the body and connected to the bottom flange of the body by an integral hinge, the cover being pivotable about the integral hinge between a first position in which the cover overlies a portion of the body and fully closes the egress opening in the side face and a second position in which the egress opening is fully revealed for unimpeded access thereto; and c) means formed in the body front face and the cover for releasably fastening the cover to the front face in the cover first position.

5. The package of claim 4 wherein the cover has a front face with an adjoining side face substantially perpendicular to the front face and a peripheral flange on the side face which is parallel to the cover front face and spaced from the cover front face such that when the cover is closed on the body the cover peripheral flange overlies and is adjacent to the flange of the body adjacent the egress opening.

6. A thermoformed blister of flexible plastic material for a reclosable blister card display package comprising:

a) a bubble body, the body having an article compartment, and top, left, right and bottom peripheral flanges for sealing to a backing card to close the article compartment, a body front face spaced from the flanges, a body side face adjoining the front face and a flange, and a body bottom face connecting the front face to the bottom flange and adjoining the side faces, wherein the side face has portions defining an egress opening, and wherein the egress opening in the body is defined by portions of the front face, the side face and the bottom face;

b) a cover independent of the body and connected to a flange of the body by an integral hinge, the cover being pivotable about the integral hinge between a first position in which the cover overlies a portion of the body and fully closes the egress opening in the side face and a second position in which the egress opening is fully revealed for unimpeded access thereto; and c) means formed in the body front face and the cover for releasably fastening the cover to the front face in the cover first position.

* * * * *